US010373622B2

(12) United States Patent
Faure et al.

(10) Patent No.: US 10,373,622 B2
(45) Date of Patent: Aug. 6, 2019

(54) CODING AND DECODING DEVICES AND METHODS USING ANALYSIS OR SYNTHESIS WEIGHTING WINDOWS FOR TRANSFORM CODING OR DECODING

(71) Applicant: Orange, Paris (FR)

(72) Inventors: Julien Faure, Ploubezre (FR); Pierrick Philippe, Melesse (FR)

(73) Assignee: ORANGE, Paris (FR)

( * ) Notice: Subject to any disclaimer, the term of this patent is extended or adjusted under 35 U.S.C. 154(b) by 536 days.

(21) Appl. No.: 15/146,362

(22) Filed: May 4, 2016

(65) Prior Publication Data

US 2017/0011747 A1 Jan. 12, 2017

Related U.S. Application Data

(63) Continuation of application No. 14/232,564, filed as application No. PCT/FR2012/051622 on Jul. 9, 2012, now Pat. No. 9,368,121.

(30) Foreign Application Priority Data

Jul. 12, 2011 (FR) ..... 11 56356

(51) Int. Cl.
*G10L 19/02* (2013.01)
*G10L 19/022* (2013.01)
*G10L 19/00* (2013.01)

(52) U.S. Cl.
CPC ..... *G10L 19/0212* (2013.01); *G10L 19/00* (2013.01); *G10L 19/022* (2013.01)

(58) Field of Classification Search
CPC .... G10L 19/00; G10L 19/0212; G10L 19/022
See application file for complete search history.

(56) References Cited

U.S. PATENT DOCUMENTS 5,357,594 A 10/1994 Fielder
5,398,083 A * 3/1995 Tsujihara ..... H04N 9/28 315/368.13
5,504,833 A 4/1996 George et al.
6,240,299 B1 * 5/2001 Song ..... H04M 1/656 455/413
6,430,529 B1 8/2002 Huang
6,748,363 B1 6/2004 Lueck et al.
(Continued)

FOREIGN PATENT DOCUMENTS

WO 2006110975 A1 10/2006
WO 2010012925 A1 2/2010

OTHER PUBLICATIONS

International Search Report and Written Opinion dated Sep. 19, 2012 for corresponding International Application No. PCT/FR2012/051622, filed Jul. 9, 2012.
(Continued)

*Primary Examiner* — Walter Yehl
(74) *Attorney, Agent, or Firm* — David D. Brush; Westman, Champlin & Koehler, P.A.

(57) ABSTRACT

A method and device are provided for coding or decoding a digital audio signal by transform using analysis or synthesis weighting windows applied to sample frames. The method includes an irregular sampling of an initial window provided for a transform of given initial size N, to apply a secondary transform of size M different from N.

12 Claims, 5 Drawing Sheets

(56) References Cited

U.S. PATENT DOCUMENTS

| | | | | |
|---|---|---|---|---|
| 7,516,064 | B2 * | 4/2009 | Vinton | G06F 17/147 704/200 |
| 7,907,089 | B2 | 3/2011 | Heurguier et al. | |
| 8,214,200 | B2 | 7/2012 | Cabot et al. | |
| 2013/0028297 | A1 * | 1/2013 | Casey | G06F 17/141 375/147 |

OTHER PUBLICATIONS

Plotkin E. et al., "Nonuniform Sampling of Bandlimited Modulated Signals", Signal Processing, Elsevier Science Publishers B.V, Amsterdam, NL, vol. 4, No. 4, Jul. 1, 1982 (Jul. 1, 1982), pp. 295-303, XP024231148.

H. S. Malvar, "Signal Processing with Lapped Transforms", Artech House, 1992.

International Preliminary Report on Patentability and English translation of the Written Opinion dated Jan. 14, 2014 for corresponding International Application No. PCT/FR2012/051622, filed Jul. 9, 2012.

French Search Report and Written Opinion dated Dec. 22, 2011 for corresponding French Application No. 1156356, filed Jul. 12, 2011.

Duhamel et al. in "A fast algorithm for the implementation of filter banks based on TDAC" (presented at the ICASSP91 conference) 1991 IEEE.

Office Action dated Aug. 12, 2015 for corresponding U.S. Appl. No. 14/232,564, filed Jan. 13, 2014.

Notice of Allowance dated Feb. 16, 2016 for corresponding U.S. Appl. No. 14/232,564, filed Jan. 13, 2014.

* cited by examiner

CODING AND DECODING DEVICES AND METHODS USING ANALYSIS OR SYNTHESIS WEIGHTING WINDOWS FOR TRANSFORM CODING OR DECODING

CROSS-REFERENCE TO RELATED APPLICATIONS

This Application is continuation of U.S. application Ser. No. 14/232,564, filed Jan. 13, 2014, which is a Section 371 National Stage Application of International Application No. PCT/FR2012/051622, filed Jul. 9, 2012, published as WO 2013/007943 on Jan. 17, 2013, not in English, the contents of which are incorporated herein by reference in their entireties.

FIELD OF THE DISCLOSURE

The present invention relates to signal processing, notably the processing of an audio (such as a speech signal) and/or video signal, in the form of a succession of samples. It relates in particular to the coding and the decoding of a digital audio signal by transform and the adaptation of the analysis or synthesis windows to the size of the transform.

BACKGROUND OF THE DISCLOSURE

Transform coding consists in coding temporal signals in the transform (frequency) domain. This transform notably makes it possible to use the frequency characteristics of the audio signals in order to optimize and enhance the performance of the coding. Use is, for example, made of the fact that a harmonic sound is represented in the frequency domain by a reduced number of spectral rays which can thus be coded concisely. The frequency masking effects are also used for example advantageously to format the coding noise in such a way that it is as little audible as possible.

Conventionally, coding and decoding by transform is performed by the application of five steps:

- The digital audio stream (sampled at a given sampling frequency Fs) to be coded is cut up into frames of finite numbers of samples (for example 2N). Each frame conventionally overlaps the preceding frame by 50%.
- A transform step is applied to the signal. In the case of the transform called MDCT (Modified Discrete Cosine Transform), a weighting window $h_a$ (called analysis window) of size L=2N is applied to each frame.
- The weighted frame is "folded" according to a 2N to N transform. The "folding" of the frame $T_{2N}$ of size 2N weighted by $h_a$ to the frame $T_N$ of size N can, for example, be done as follows:

$$\begin{cases} T_N(k) = -T_{2N}\left(\frac{3N}{2}-k-1\right)h_a\left(\frac{3N}{2}-k-1\right) - T_{2N}\left(\frac{3N}{2}+k\right)h_a\left(\frac{3N}{2}+k\right) \\ T_N(N/2+k) = T_{2N}(k)h_a(k) - T_{2N}(N-k-1)h_a(N-k-1) \end{cases} \quad (1)$$

$$k \in [0; N/2-1]$$

a DCT IV is applied to the folded frame $T_N$ in order to obtain a frame of size N in the transformed domain. It is expressed as follows:

$$T'_N(u) = \sqrt{\frac{2}{M}\sum_{k=0}^{N-1} T_N(k)\cos\left[\frac{\pi}{M}\left(k+\frac{1}{2}\right)\left(u+\frac{1}{2}\right)\right]}$$

- The frame in the transformed domain is then quantized by using a matched quantizer. The quantization makes it possible to reduce the size of the data to be transmitted but introduces a noise (audible or not) into the original frame. The higher the bit rate of the coding, the more this noise is reduced and the closer the quantized frame is to the original frame.
- An inverse MDCT transform is applied in decoding to the quantized frame. It comprises two steps: the quantized frame of size N is converted into a frame of size N in the time domain $T_N$* by using an inverse DCT IV (which is expressed as a direct transform).
- A second step of "unfolding" from N to 2N is then applied to the time frame $T_N$* of size N. Weighting windows $h_s$, called synthesis windows, are applied to the frames $T_{2N}$* of sizes 2N according to the following equation:

$$\begin{cases} T^*_{2N}(k) = T^*_N\left(\frac{N}{2}+k\right)h_s(k) \\ T^*_{2N}\left(\frac{N}{2}+k\right) = -T^*_N(N-k-1)h_s\left(\frac{N}{2}+k\right) \\ T^*_{2N}(N+k) = -T^*_N\left(\frac{N}{2}-k-1\right)h_s(N+k) \\ T^*_{2N}\left(\frac{3N}{2}+k\right) = -T^*_N(k)h_s\left(\frac{3N}{2}+k\right) \end{cases} \quad (2)$$

$$k \in [0; N/2-1]$$

- The decoded audio stream is then synthesized by summing the overlapping parts of two consecutive frames.

Note that this scheme extends to transforms that have a greater overlap, such as the ELTs for which the analysis and synthesis filters have a length L=2KN for an overlap of (2K-1)N. The MDCT is thus a particular case of the ELT with K=1.

For a transform and a given overlap, analysis and synthesis windows are determined which make it possible to obtain a so-called "perfect" reconstruction of the signal to be coded (in the absence of quantization).

The reconstruction can also be "quasi-perfect" reconstruction when the difference between the original X and reconstructed $\hat{X}$ signals can be considered negligible. For example, in audio coding, a difference that has an error power 50 dB lower than the power of the processed signal X can be considered to be negligible.

For example, in the case where the analysis and synthesis windows do not change over two consecutive frames, they should observe the following perfect reconstruction conditions:

$$\begin{cases} h_a(N+k)h_s(N+k) + h_a(k)h_s(k) = 1 \\ h_a(N+k)h_s(2N-k-1) - h_a(k)h_s(N-1-k) = 0 \end{cases} \quad (3)$$

$$k \in [0; N-1]$$

Thus, it will be easily understood that, in most codecs, the analysis and synthesis windows are stored in memory, they are either computed in advance and stored in ROM memory or initialized using formulae and nevertheless stored in RAM memory.

Most of the time, the analysis and synthesis windows are identical ($h_s(k)=h_a(k)$), sometimes except for an index reversal ($h_s(k)=h_a(2N-1-k)$), they then require only a single memory space of size 2N for their storage in memory.

The new codecs work with different frame sizes N, whether to manage a plurality of sampling frequencies, or to adapt the size of the analysis (and therefore synthesis) window to the audio content (for example in the case of transitions). In these codecs, the ROM or RAM memory contains as many analysis and/or synthesis windows as there are different frame sizes.

The coefficients (also called samples) of the analysis or synthesis windows of the coder or of the decoder, should be stored in memory in order to perform the analysis or synthesis transform. Obviously, in a particular case using transforms of different sizes, the weighting window for each of the sizes used must be represented in memory.

In the favorable case where the windows are symmetrical, only L/2 coefficients need to be stored, the other L/2 being deduced without any arithmetical operation from these stored coefficients. Thus, for an MDCT (K=1), if there is a need for a transform of size M and 2.M, then (M+2M)=3M coefficients must be stored if the windows are symmetrical and (2M+4M)=6M coefficients be stored otherwise. A typical example for audio coding is M=320 or M=1024. Thus, for the asymmetrical case, this means that 1920 and 6144 coefficients respectively must be stored.

Depending on the precision desired for the representation of the coefficients, 16 bits, even 24 bits, for each coefficient are needed. This means a not inconsiderable memory space for low-cost computers.

Analysis or synthesis window decimation techniques do exist.

A simple window decimation, for example in order to change from N samples to M (N being a multiple of M), consists in taking one sample in N/M with N/M being an integer >1.

Such a computation does not make it possible to observe the perfect reconstruction equation given in equation (3).

For example, in the case where the synthesis window is the temporal reversal of the analysis window, the following applies:

$$h_s(2N-k-1)=h_a(k)=h(k)$$

$$\text{for } k\in[0;2N-1] \tag{4}$$

The perfect reconstruction condition becomes:

$$h(N+k)h(N-k-1)+h(k)h(2N-k-1)=1$$

$$\text{for } k\in[0;2N-1] \tag{5}$$

A window conventionally used in coding to meet this condition is the Malvar sinusoidal window:

$$h(k)=\sin\left(\frac{\pi}{2N}(k+0.5)\right) \tag{6}$$

$$\text{for } k\in[0;2N-1]$$

If the window h(k) is decimated by taking one sample in N/M, this window becomes:

$$h^*(k)=h\left(\frac{kN}{M}\right)=\sin\left(\frac{\pi}{2N}\left(\frac{kN}{M}+0.5\right)\right)$$

$$\text{for } k\in[0;2M-1]$$

For h*(k) of size 2M to confirm the perfect reconstruction condition (in equation (3)), $$h^*(M+k)h^*(M-k-1)+h^*(k)h^*(2M-k-1)=\cos\left(\frac{\pi}{2N}\left(\frac{kN}{M}+0.5\right)\right)\cos\left(\frac{\pi}{2N}\left(\frac{kN}{M}+\frac{N}{M}-0.5\right)\right)+\sin\left(\frac{\pi}{2N}\left(\frac{kN}{M}+0.5\right)\right)\sin\left(\frac{\pi}{2N}\left(\frac{kN}{M}+\frac{N}{M}-0.5\right)\right)=1$$

$$\text{for } k\in[0;M-1]$$

N/M must be equal to 1; now, N/M is defined as an integer >1, therefore, for such a decimation, the perfect reconstruction condition cannot be confirmed.

The illustrative example taken here is easily generalized. Thus, by direct decimation of a basic window to obtain a window of reduced size, the perfect reconstruction property cannot be assured.

Weighting window interpolation techniques also exist. Such a technique is, for example, described in the published patent application EP 2319039.

This technique makes it possible to reduce the size of windows stored in ROM when a window of greater size is needed.

Thus, instead of storing a window of size 2N and a window of size 4N, the patent application proposes assigning the samples of the 2N window to one sample in two of the 4N window and storing in ROM only the missing 2N samples. The storage size in ROM is thus reduced from 4N+2N to 2N+2N.

However, this technique also requires a preliminary analysis and synthesis window computation before applying the actual transform.

There is therefore a need to store only a reduced number of analysis windows and synthesis windows in memory to apply transforms of different sizes while observing the perfect reconstruction conditions. Furthermore, there is felt to be a need to avoid the steps of preliminary computation of these windows before the coding by transform.

SUMMARY

An aspect of the present disclosure relates to method of coding or decoding a digital audio signal by transform using analysis ($h_a$) or synthesis ($h_s$) weighting windows applied to sample frames. The method is such that it comprises an irregular sampling (E10) of an initial window provided for a transform of given initial size N, to apply a secondary transform of size M different from N.

Thus, from a stored initial window, provided for a transform of size N, it is possible to apply a transform of different size without preliminary computations being performed and without other windows of different sizes being stored.

A single window of any size can thus suffice to adapt it to transforms of different sizes.

The irregular sampling makes it possible to observe the so-called "perfect" or "quasi-perfect" reconstruction conditions during the decoding.

The various particular embodiments mentioned hereinbelow can be added independently or in combination with one another, to the steps of the coding or decoding method defined hereinabove.

According to a preferred embodiment, the sampling step comprises the selection, from a first coefficient d of the initial window (with $0 \le d < N/M$), of a defined set of coefficients N−d−1, N+d, 2N−d−1, observing a predetermined perfect reconstruction condition.

Thus, it is possible, from a set of coefficients, to determine windows matched to secondary transforms of different sizes while observing the perfect reconstruction conditions.

Advantageously, when N is greater than M, a decimation of the initial window is performed by retaining at least the coefficients of the defined set to obtain a decimated window.

Thus, from a stored analysis or synthesis window of greater size, it is possible to obtain a window of smaller size which also observes the perfect reconstruction conditions in decoding.

In a particular exemplary embodiment, the method comprises the selection of a second set of coefficients spaced apart by a constant difference with the coefficients of the defined set and the decimation is performed by also retaining the coefficients of the second set to obtain the decimated window.

Thus, a decimation matched to the desired transform size can be obtained. This makes it possible to best conserve the frequency response of the windows obtained.

In a particular embodiment, the decimation of a window of size 2N into a window of size 2M is performed according to the following equations:

$$\text{for } k \in [0; M/2-1]$$

$$\begin{cases} h^*(k) = h\left(\left\lceil k\frac{N}{M}\right\rceil + d\right) \\ h^*(2M-k-1) = h\left(\left\lfloor 2N-1-k\frac{N}{M}\right\rfloor - d\right) \\ h^*(M+k) = h\left(\left\lceil N+k\frac{N}{M}\right\rceil + d\right) \\ h^*(M-k-1) = h\left(\left\lfloor N-1-k\frac{N}{M}\right\rfloor - d\right) \end{cases}$$

where h* is the decimated analysis or synthesis window, h is the initial analysis or synthesis window, $\lfloor X \rfloor$ is the closest integer $\le X$, $\lceil X \rceil$ is the closest integer $\ge X$ and d is the value of the first coefficient of the defined set.

Thus, it is possible to obtain windows of different sizes from a window of greater size even when the number of coefficients between the initial window and the window obtained is not multiple.

When N is less than M, an interpolation is performed by inserting a coefficient between each of the coefficients of the set of defined coefficients and each of the coefficients of a set of adjacent coefficients to obtain an interpolated window.

The interpolated window also observes a perfect reconstruction and can be computed on the fly from a stored window of smaller size.

In a particular embodiment, the method comprises the selection of a second set of coefficients spaced apart by a constant difference with the coefficients of the defined set and the interpolation is performed by also inserting a coefficient between each of the coefficients of the second set and each of the coefficients of a set of adjacent coefficients to obtain the interpolated window.

Thus, an interpolation matched to the desired transform size can be obtained. This makes it possible to best retain the frequency response of the windows obtained.

In order to optimize the frequency response of the interpolated window, in a particular embodiment, the method comprises the computation of a complementary window comprising coefficients computed from the defined coefficients of the set and from the adjacent coefficients, to interpolate said window.

In a preferred embodiment, the irregular sampling step and a decimation or interpolation of the initial window are performed during the step of implementing the temporal folding or unfolding used for the computation of the secondary transform.

Thus, the decimation or the interpolation of an analysis or synthesis window is performed at the same time as the actual transform step, therefore on the fly. It is therefore no longer useful to perform preliminary computation steps before the coding, windows matched to the size of the transform being obtained during the coding.

In an exemplary embodiment, both a decimation and an interpolation of the initial window are performed during the step of implementing the temporal folding or unfolding used for the computation of the secondary transform.

This makes it possible to offer more possibilities for obtaining windows of different sizes from a single window stored in memory.

In a particular embodiment case for the decimation, the decimation during the temporal folding is performed according to the following equation:

$$\begin{cases} T_M(k) = -T_{2M}\left(\frac{3M}{2}-k-1\right)h_a\left(\left\lceil \frac{3N}{2}-(k+1)\frac{N}{M}\right\rceil + d\right) - \\ T_{2M}\left(\frac{3M}{2}+k\right)h_a\left(\left\lfloor \frac{3N}{2}-1+(k+1)\frac{N}{M}\right\rfloor - d\right) \\ T_M(M/2+k) = T_{2M}(k)h_a\left(\left\lceil k\frac{N}{M}\right\rceil + d\right) - \\ T_{2M}(M-k-1)h_a\left(\left\lfloor N-1-k\frac{N}{M}\right\rfloor - d\right) \end{cases}$$

$$k \in [0; M/2-1]$$

with $T_M$ being a frame of M samples, $T_{2M}$, a frame of 2M samples and the decimation during the temporal unfolding is performed according to the following equation:

$$\begin{cases} T^*_{2M}(k) = T^*_M\left(\frac{M}{2}+k\right)h_s\left(\left\lceil k\frac{N}{M}\right\rceil + d\right) \\ T^*_{2M}\left(\frac{M}{2}+k\right) = -T^*_M(M-k-1)h_s\left(\left\lfloor \frac{N}{2}-1+(k+1)\frac{N}{M}\right\rfloor - d\right) \\ T^*_{2M}(M+k) = -T^*_M\left(\frac{M}{2}-k-1\right)h_s\left(\left\lceil N+k\frac{N}{M}\right\rceil + d\right) \\ T^*_{2M}\left(\frac{3M}{2}+k\right) = -T^*_M(k)h_s\left(\left\lfloor \frac{3N}{2}-1+(k+1)\frac{N}{M}\right\rfloor - d\right) \end{cases}$$

$$k \in [0; N/2-1]$$

with $T^*_M$ being a frame of M samples, $T^*_{2M}$, a frame of 2M samples.

In a particularly matched exemplary embodiment, when the secondary transform is of size M=3/2N, a decimation of the initial window followed by an interpolation is performed during the temporal folding according to the following equations:

$$\begin{cases} T_M(k+1) = -T_{2M}\left(\frac{3M}{2} - (k+1) - 1\right)h\left(\frac{3N}{2} - k/2 - 1\right) - \\ T_{2M}\left(\frac{3M}{2} + k + 1\right)h\left(\frac{3N}{2} + k/2\right) \\ T_M(k) = -T_{2M}\left(\frac{3N}{2} - k - 1\right)hcomp\left(\frac{3N}{2} - k/2 - 1\right) - \\ T_{2M}\left(\frac{3N}{2} + k\right)hcomp\left(\frac{3N}{2} + k/2\right) \\ T_M(N/2+k) = T_{2M}(k)h(k/2) - T_{2M}(N-k-1)h(N-k/2-1) \\ T_M(N/2+k+1) = T_{2M}(k+1)hcomp(k/2) - \\ T_{2M}(N-(k+1)-1)hcomp(N-k/2-1) \end{cases}$$

$$k/2 \in [0; N/2-1]$$

with $T_M$ being a frame of M samples, $T_{2M}$, a frame of 2M samples, hcomp the complementary window and, when the secondary transform is of size M=3/2N, a decimation of the initial window followed by an interpolation is performed during the temporal unfolding according to the following equations:

$$\begin{cases} T^*_{2M}(k) = T^*_M\left(\frac{N}{2} + k\right)h(2N - k/2 - 1) \\ T^*_{2M}(k+1) = T^*_M\left(\frac{N}{2} + k + 1\right)hcomp(2N - k/2 - 1) \\ T^*_{2M}\left(\frac{N}{2} + k + 1\right) = -T^*_M(N-(k+1)-1)h\left(\frac{3N}{2} - k/2 - 1\right) \\ T^*_{2M}\left(\frac{N}{2} + k\right) = -T^*_M(N-k-1)hcomp\left(\frac{3N}{2} - k/2 - 1\right) \\ T^*_{2M}(N+k) = -T^*_M\left(\frac{N}{2} - k - 1\right)h(N - k/2 - 1) \\ T^*_{2M}(N+k+1) = -T^*_M\left(\frac{N}{2} - (k+1) - 1\right)hcomp(N - k/2 - 1) \\ T^*_{2M}\left(\frac{3N}{2} + k + 1\right) = -T^*_M(k+1)h\left(\frac{N}{2} - k/2 - 1\right) \\ T^*_{2M}\left(\frac{3N}{2} + k\right) = -T^*_M(k)hcomp\left(\frac{N}{2} - k/2 - 1\right) \end{cases}$$

$$k/2 \in [0; N/2-1]$$

with $T_M$ being a frame of M samples, $T_{2M}$, a frame of 2M samples, hcomp the complementary window.

The present invention also targets a device for coding or decoding a digital audio signal by transform using analysis or synthesis weighting windows applied to sample frames. The device is such that it comprises a sampling module matched for irregularly sampling an initial window provided for a transform of given initial size N, in order to apply a secondary transform of size M different from N.

This device offers the same advantages as the method described previously, which it implements.

It targets a computer program comprising code instructions for the implementation of the steps of the coding or decoding method as described, when these instructions are run by a processor.

Finally, the invention relates to a processor-readable storage medium, incorporated or not in the coding or decoding device, possibly removable, storing a computer program implementing a coding or decoding method as described previously.

BRIEF DESCRIPTION OF THE DRAWINGS

Other features and advantages of the invention will become more clearly apparent on reading the following description, given purely as a nonlimiting example, and with reference to the appended drawings in which.

DETAILED DESCRIPTION OF ILLUSTRATIVE EMBODIMENTS

Figure 1:
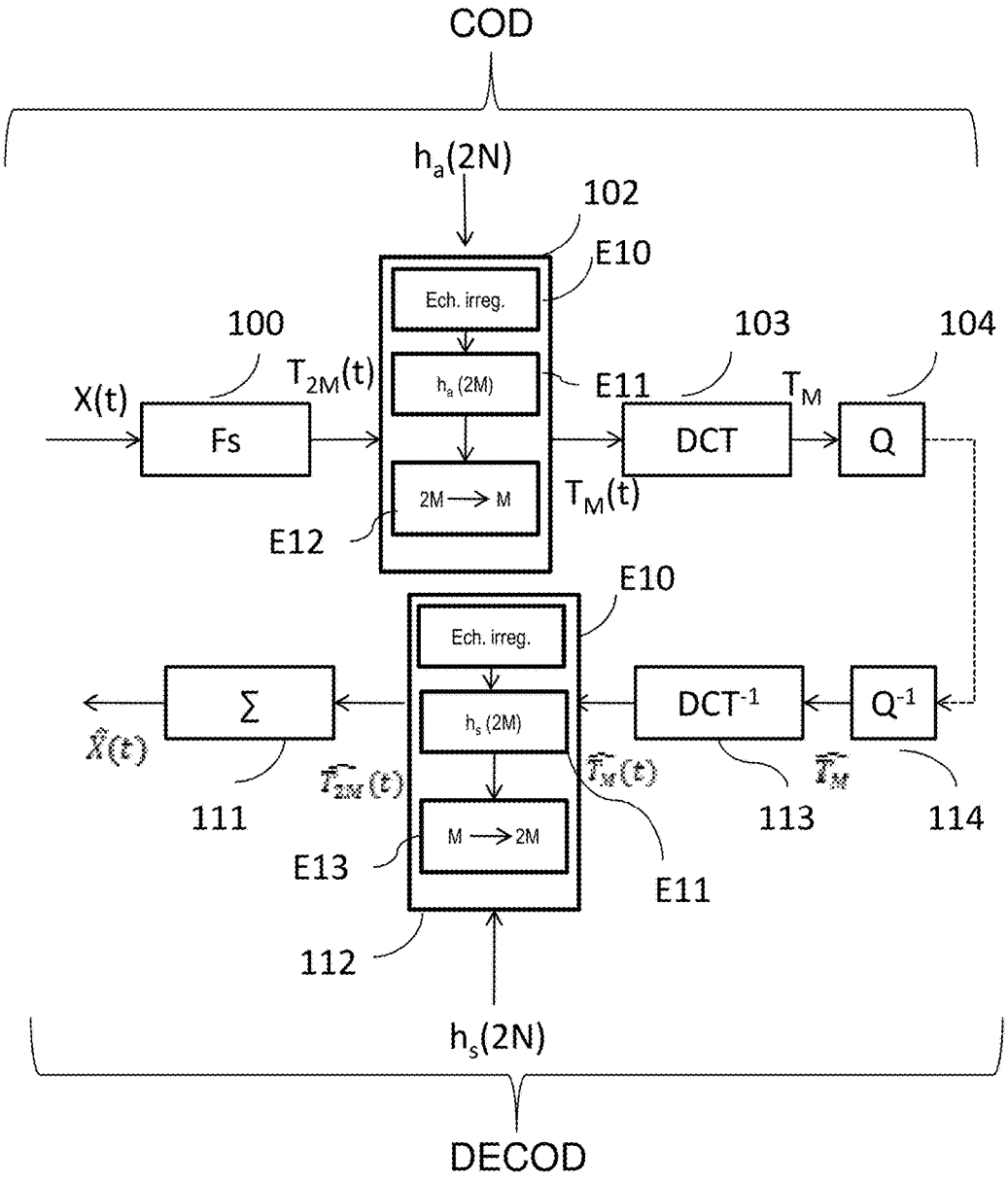
FIG. 1 illustrates an example of a coding and decoding system implementing the invention in one embodiment.

FIG. 1 illustrates a system for coding and decoding by transform in which a single analysis window and a single synthesis window of size 2N are stored in memory.

The digital audio stream X(t) is sampled by the sampling module 100 at a sampling frequency $F_s$, frames $T_{2m}(t)$ of 2M samples being thus obtained. Each frame conventionally overlaps by 50% with the preceding frame.

A transform step is then applied to the signal by the blocks 102 and 103. The block 102 performs a sampling of the stored initial window provided for a transform of size N to apply a secondary transform of size M different from N. A sampling of the analysis window $h_a$ of 2N coefficients is then performed to adapt it to the frames of 2M samples of the signal.

In the case where N is a multiple of M, it is a decimation and, in the case where N is a submultiple of M, it is an interpolation. The case where N/M is any of these is provided.

The steps implemented by the block 102 will be detailed later with reference to FIGS. 2 and 3A and 3B.

The block 102 also performs a folding on the weighted frame according to 2M to M transform. Advantageously, this folding step is performed in combination with the irregular sampling and decimation or interpolation step as described later.

Thus, after the block 102, the signal is in the form of a frame $T_M(t)$ of M samples. A transform of DCT IV type, for example, is then applied by the block 103 to obtain frames $T_M$ of size M in the transformed domain, that is to say, here, in the frequency domain.

These frames are then quantized by the quantization module 104 to be transmitted to a decoder in quantization index form $I_Q$.

The decoder performs a reverse quantization by the module 114 to obtain frames $\tilde{T}_M$ in the transformed domain. The inverse transform module 113 performs, for example, an inverse DCT IV to obtain frames $\tilde{T}_M$ (t) in the time domain.

An unfolding from M to 2M samples is then performed by the block 112 on the frame $\widetilde{\tilde{r}_M}(t)$. A synthesis weighting window of size 2M is obtained by the block 112 by decimation or interpolation from a window $h_s$ of size 2N.

In the case where N is greater than M, it is a decimation and, in the case where N is less than M, it is an interpolation.

The steps implemented by the block 112 will be detailed later with reference to FIGS. 2 and 3A and 3B.

As for the coding, advantageously, this unfolding step is performed in combination with the irregular sampling and decimation or interpolation step and will be described later.

The decoded audio stream $\hat{X}(t)$ is then synthesized by summing the overlapping parts in the block 111.

The block 102 as well as the block 112 are now described in more detail.

These blocks perform the irregular sampling steps E10 to define a window matched to the size M of a secondary transform.

Thus, from a first coefficient d (with $0 \leq d < N/M$) of the stored window ($h_a$ or $h_s$) of size 2N, a defined set of coefficients N−d−1, N+d, 2N−d−1, observing a predetermined perfect reconstruction condition, is selected.

From this set, a decimation or an interpolation of said window is performed in E11 according to whether N is greater than or less than M, to change from a window of 2N samples to a window of 2M samples.

A predetermined perfect reconstruction condition is sought. For this, the sampling has to be performed in such a way that the following equations are observed (ensuring that the coefficients chosen for the synthesis and analysis allow for the perfect reconstruction for a transform of size N):

$$\begin{cases} h_a(N+k)h_s(N+k) + h_a(k)h_s(k) = 1 \\ h_a(N+k)h_s(2N-k-1) - h_a(k)h_s(N-1-k) = 0 \end{cases}$$

$$k \in [0; N-1]$$

Thus, for a decimated window to observe the perfect reconstruction conditions of the equation (3), from a point $h_a(k)$ (for $k \in [0; 2N-1]$) on the analysis window, only the additional selection of the points $h_a(N+k)$ on the analysis window and of the points $h_s(k)$, $h_s(N+k)$, $h_s(2N-1-k)$ and $h_s(N-1-k)$ on the synthesis window condition the perfect reconstruction.

However, by retaining only these 6 points, it will be observed that there is then a disparity, the analysis window is decimated by N and the synthesis window by N/2.

Similarly, it will be noted that, if the decimation involves selecting the point N−k−1 on the analysis window $h_a(N-k-1)$, only the selection of the points $h_a(2N-1-k)$ on the analysis window and of the 4 same points $h_s(k)$, $h_s(N+k)$, $h_s(2N-1-k)$ and $h_s(N-1-k)$ on the synthesis window makes it possible to observe the perfect reconstruction condition.

Thus, during a decimation as illustrated with reference to FIG. 2, to observe the perfect reconstruction conditions in (3), from a coefficient d taken for $0<d<N/M$, it is absolutely essential for the following coefficients N−d−1, N+d, 2N−1−d on the analysis wnidow and d, N+d, 2N−1−d and N−1−d on the synthesis window to be also selected to have a decimation of the same size between the analysis window and the synthesis window.

Figure 2:
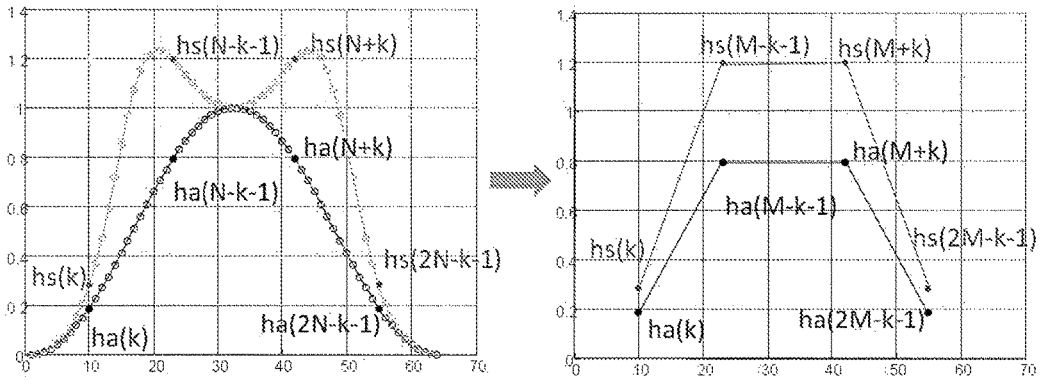
FIG. 2 illustrates an example of analysis or synthesis window decimation according to the invention.

In practice, the perfect reconstruction condition applies only to subsets of 8 points independently as illustrated in FIG. 2.

The selection of the defined set of coefficients d, N−d−1, N+d, 2N−1−d on the analysis window and on the synthesis window is thus performed.

The decimation is then performed by retaining at least the coefficients of the defined set to obtain the decimated window, the other coefficients being able to be deleted. The smallest decimated window which observes the perfect reconstruction conditions is thus obtained.

Thus, to obtain the smallest decimated analysis window, only the points $h_a(k)$, $h_a(N+k)$, $h_a(2N-1-k)$ and $h_a(N-1-k)$ are kept as illustrated in the example referred to in FIG. 2.

For the synthesis window, the same set of coefficients is selected and the decimation is performed by retaining at least the coefficients of the defined set to obtain the decimated window.

Thus, to obtain the smallest decimated synthesis window, only the points $h_s(k)$, $h_s(N+k)$, $h_s(2N-1-k)$ and $h_s(N-1-k)$ are kept as illustrated in the example referred to in FIG. 2.

Given the symmetries between the points, in the case where the synthesis window is the temporal reversal of the analysis window, only a subset of 4 points (h(k), h(N+k), h(2N−1−k) and h(N−1−k)) is necessary to the decimation.

Thus, by selecting the set defined above, it is possible to decimate an analysis and/or synthesis window by choosing any values of k between 0 and N−1 while retaining the perfect reconstruction properties.

A matched decimation makes it possible to best conserve the frequency response of the window to be decimated.

In the case of a matched decimation, with a transform size M, one coefficient in N/M on the first quarter of the analysis (or synthesis) window is taken and a second set of coefficients spaced apart by a constant difference (of N/M) with coefficients of the defined set, is selected. Thus, the decimation is performed by conserving, in addition to the coefficients d, N−1−d, N+d, 2N−1−d, the coefficients of the second set to obtain the decimated window.

Figure 3A:
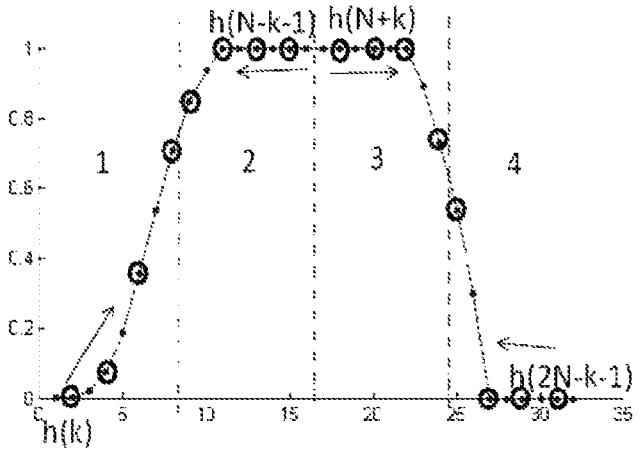
FIGS. 3A and 3B illustrate an irregular sampling of an analysis or synthesis window to obtain a window according to an embodiment of the invention.
Figure 3B:
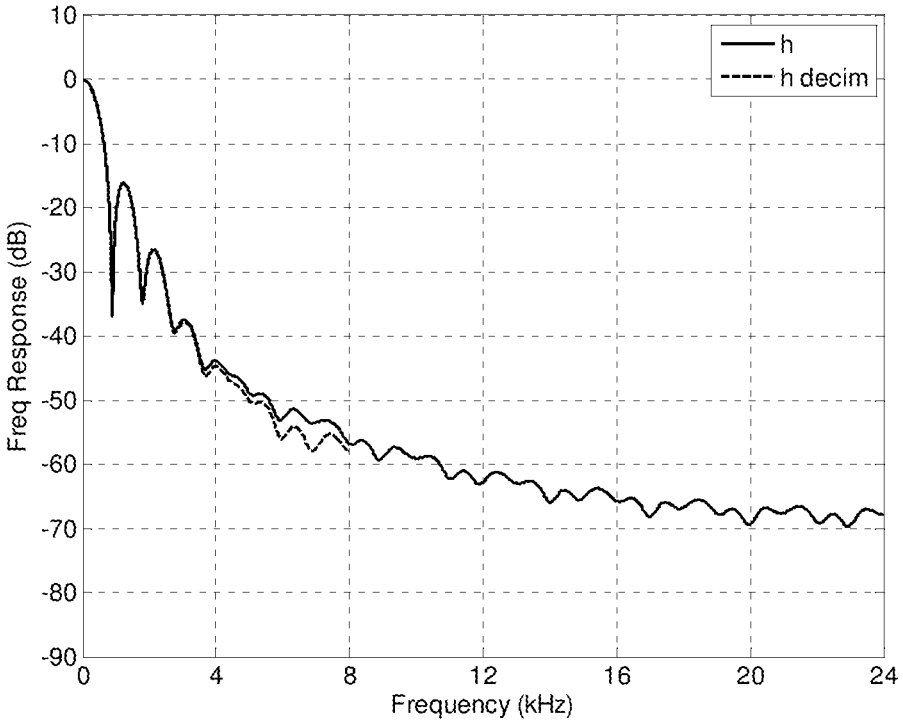

FIGS. 3A and 3B illustrate an example of irregular sampling matched to a transform size M. The window represented being divided up into four quarters.

Given the perfect reconstruction conditions, the following equations are obtained in order to obtain the decimated window of size 2M:

$$\text{for } 1rk \in [0; M/2-1] \tag{7}$$

$$\begin{cases} h^*(k) = h\left(\left\lceil k\frac{N}{M}\right\rceil + d\right) \\ h^*(2M-k-1) = h\left(\left\lfloor 2N-1-k\frac{N}{M}\right\rfloor - d\right) \\ h^*(M+k) = h\left(\left\lceil N+k\frac{N}{M}\right\rceil + d\right) \\ h^*(M-k-1) = h\left(\left\lfloor N-1-k\frac{N}{M}\right\rfloor - d\right) \end{cases}$$

where h* is the interpolated or decimated analysis or synthesis window, h is the initial analysis or synthesis window, $\lfloor X \rfloor$ is the closest integer $\leq X$, $\lceil X \rceil$ is the closest integer $\geq X$. d is the offset.

The offset is a function of the starting sample d on the first quarter of the window.

Thus, the step E10 of the block 102 comprises the selection of a second set of coefficients spaced apart by a constant difference (here N/M) from the coefficients of the defined set (d, N−d−1, N+d, 2N−d−1). The same constant difference can be applied to select a third set of coefficients.

In practice, for example if the window is decimated by 3, that is to say that N/M=3, the difference is therefore 3 in each window portion. If d=0 is the first coefficient of the defined set, the coefficients of a second or third set spaced apart by a constant difference are then 3 and 6, and so on.

Similarly, if d=1, the first coefficients of the second or third sets spaced apart by a constant difference are 1, 4, 7 . . . or else the coefficients 2, 5, 8 . . . for d=2.

"d" in equation 7 can therefore take the values 0, 1 or 2 (between 0 and N/M−1 inclusive).

FIGS. 3A and 3B represent the case where the first coefficient chosen in the first quarter of the window is d=1.

The coefficients of the second and third sets spaced apart by a constant difference are then 4 and 7.

Table 1 below illustrates the points retained for the change from a transform of size N=48 to transforms of smaller size (M=24, 16, 12 and 8). It will thus be seen that, to implement the transform of size M=8, the samples 0, 6, 12, 18, 29, 35, 41, 47, 48, 54, 60, 66, 77, 83, 89 and 95 are considered in the analysis or synthesis window, thus showing the irregular sampling.

TABLE 1

| index | M = 24; N/M = 2 | M = 16; N/M = 3 | M = 12; N/M = 4 | M = 8; N/M = 6 | M = 6; N/M = 8 |
|---|---|---|---|---|---|
| 0 | 0 | 0 | 0 | 0 | 0 |
| 1 | 2 | 3 | 4 | 6 | 8 |
| 2 | 4 | 6 | 8 | 12 | 16 |
| 3 | 6 | 9 | 12 | 18 | 31 |
| 4 | 8 | 12 | 16 | 29 | 39 |
| 5 | 10 | 15 | 20 | 35 | 47 |
| 6 | 12 | 18 | 27 | 41 | 48 |
| 7 | 14 | 21 | 31 | 47 | 56 |
| 8 | 16 | 26 | 35 | 48 | 64 |
| 9 | 18 | 29 | 39 | 54 | 79 |
| 10 | 20 | 32 | 43 | 60 | 87 |
| 11 | 22 | 35 | 47 | 66 | 95 |
| 12 | 25 | 38 | 48 | 77 | |
| 13 | 27 | 41 | 52 | 83 | |
| 14 | 29 | 44 | 56 | 89 | |
| 15 | 31 | 47 | 60 | 95 | |
| 16 | 33 | 48 | 64 | | |
| 17 | 35 | 51 | 68 | | |
| 18 | 37 | 54 | 75 | | |
| 19 | 39 | 57 | 79 | | |

TABLE 1-continued

| index | M = 24; N/M = 2 | M = 16; N/M = 3 | M = 12; N/M = 4 | M = 8; N/M = 6 | M = 6; N/M = 8 |
|---|---|---|---|---|---|
| 20 | 41 | 60 | 83 | | |
| 21 | 43 | 63 | 87 | | |
| 22 | 45 | 66 | 91 | | |
| 23 | 47 | 69 | 95 | | |
| 24 | 48 | 74 | | | |
| 25 | 50 | 77 | | | |
| 26 | 52 | 80 | | | |
| 27 | 54 | 83 | | | |
| 28 | 56 | 86 | | | |
| 29 | 58 | 89 | | | |
| 30 | 60 | 92 | | | |
| 31 | 62 | 95 | | | |
| 32 | 64 | | | | |
| 33 | 66 | | | | |
| 34 | 68 | | | | |
| 35 | 70 | | | | |
| 36 | 73 | | | | |
| 37 | 75 | | | | |
| 38 | 77 | | | | |
| 39 | 79 | | | | |
| 40 | 81 | | | | |
| 41 | 83 | | | | |
| 42 | 85 | | | | |
| 43 | 87 | | | | |
| 44 | 89 | | | | |
| 45 | 91 | | | | |
| 46 | 93 | | | | |
| 47 | 95 | | | | |

Table 2 below illustrates an embodiment for changing from an initial window provided for a transform of size N=48 to a window suitable for producing a transform of size N=6. There is then a decimation of N/M=8 and 7 possibilities for the value of d: d=0 . . . 7. The table indicates the indices corresponding to the values retained in the initial window.

TABLE 2

| index | N/M = 8, d = 0 | N/M = 8, d = 1 | N/M = 8, d = 2 | N/M = 8, d = 3 | N/M = 8, d = 4 | N/M = 8, d = 5 | N/M = 8, d = 6 | N/M = 8, d = 7 |
|---|---|---|---|---|---|---|---|---|
| 0 | 0 | 1 | 2 | 3 | 4 | 5 | 6 | 7 |
| 1 | 8 | 9 | 10 | 11 | 12 | 13 | 14 | 15 |
| 2 | 16 | 17 | 18 | 19 | 20 | 21 | 22 | 23 |
| 3 | 31 | 30 | 29 | 28 | 27 | 26 | 25 | 24 |
| 4 | 39 | 38 | 37 | 36 | 35 | 34 | 33 | 32 |
| 5 | 47 | 46 | 45 | 44 | 43 | 42 | 41 | 40 |
| 6 | 48 | 49 | 50 | 51 | 52 | 53 | 54 | 55 |
| 7 | 56 | 57 | 58 | 59 | 60 | 61 | 62 | 63 |
| 8 | 64 | 65 | 66 | 67 | 68 | 69 | 70 | 71 |
| 9 | 79 | 78 | 77 | 76 | 75 | 74 | 73 | 72 |
| 10 | 87 | 86 | 85 | 84 | 83 | 82 | 81 | 80 |
| 11 | 95 | 94 | 93 | 92 | 91 | 90 | 89 | 88 |

So as to have a frequency response that is closer to the original window, the invention proposes setting the value to $$d = \max\left(0, \left\lfloor 0.5\left(\frac{N}{M} - 1\right)\right\rfloor\right).$$

This condition is not limiting.

If it is considered that the starting point is the end of each segment, equation 7 becomes $$\text{for } 1rk \in [0; M/2-1] \tag{8}$$

$$\begin{cases} h^*(k) = h\left(\left\lceil k\frac{N}{M}\right\rceil + d\right) \\ h^*\left(\frac{3M}{2} + k\right) = h\left(\left\lfloor \frac{3N}{2} - 1 + (k+1)\frac{N}{M}\right\rfloor - d\right) \\ h^*\left(\frac{3M}{2} - k - 1\right) = h\left(\left\lceil \frac{3N}{2} - (k+1)\frac{N}{M}\right\rceil + d\right) \\ h^*(M-k-1) = h\left(\left\lfloor N - 1 - k\frac{N}{M}\right\rfloor - d\right) \end{cases}$$

In each portion, it is also possible, to perform the transform of size M, to arbitrarily choose the points in the initial window of size 2N. From a first coefficient (h(d)) M/2−1 coefficients can be taken arbitrarily from the first quarter of the window, with indices $d_k$, conditional on selecting the coefficients of index $2N-1-d_k$ , $N-1-d_k$ and $N+d_k$ in the other three portions. This is particularly advantageous for improving the continuity or the frequency response of the window of size 2M that is constructed: the discontinuities can in particular be limited by a shrewd choice of the indices $d_k$.

Table 3 below illustrates a particular embodiment, with 2N=48, 2M=16.

TABLE 3

| k | index |
|---|---|
| 0 | 1 |
| 1 | 5 |
| 2 | 11 |
| 3 | 19 |
| 4 | 28 |
| 5 | 36 |
| 6 | 42 |
| 7 | 46 |
| 8 | 49 |
| 9 | 53 |
| 10 | 59 |
| 11 | 67 |
| 12 | 76 |
| 13 | 84 |
| 14 | 90 |
| 15 | 94 |

In an advantageous embodiment, the blocks 102 and 112 perform the sampling steps at the same time as the step of folding or unfolding of the signal frames.

In the case described here, an analysis weighting window $h_a$ of size 2N is applied to each frame of size 2M by decimating it or by interpolating it on the fly in the block 102.

This step is performed by grouping together the equations (1) describing the folding step and the equations (7) describing an irregular decimation.

The weighted frame is "folded" according to a 2M to M transform. The "folding" of the frame $T_{2M}$ of size 2M weighted by $h_a$ (of size 2N) to the frame $T_M$ of size M can for example be done as follows:

$$\begin{cases} T_M(k) = -T_{2M}\left(\frac{3M}{2} - k - 1\right)h_a\left(\left\lceil \frac{3N}{2} - (k+1)\frac{N}{M}\right\rceil + d\right) - \\ T_{2M}\left(\frac{3M}{2} + k\right)h_a\left(\left\lfloor \frac{3N}{2} - 1 + (k+1)\frac{N}{M}\right\rfloor - d\right) \\ T_M(M/2+k) = T_{2M}(k)h_a\left(\left\lceil k\frac{N}{M}\right\rceil + d\right) - \\ T_{2M}(N-k-1)h_a\left(\left\lfloor N - 1 - k\frac{N}{M}\right\rfloor - d\right) \end{cases} \tag{9}$$

$$k \in [0; M/2-1]$$

Thus, the step of decimation of a window of size 2N to a window of size 2M is done at the same time as the folding of a frame of size 2M to a frame of size M.

The computations performed are of the same complexity as those used for a conventional folding, only the indices being changed. This on-the-fly decimation operation does not entail additional complexity.

Similarly, on decoding, a synthesis weighting window h, of size 2N is decimated on the fly in the block 112, into a window of size 2M to be applied to each frame of size 2M. This step is performed by grouping together the unfolding equations (2) with the decimation equations (7) or (8).

The following equation is thus obtained:

$$\begin{cases} T^*_{2M}(k) = T^*_M\left(\frac{M}{2} + k\right)h_s\left(\left\lceil k\frac{N}{M}\right\rceil + d\right) \\ T^*_{2M}\left(\frac{M}{2} + k\right) = -T^*_M(M-k-1)h_s\left(\left\lfloor \frac{N}{2} - 1 + (k+1)\frac{N}{M}\right\rfloor - d\right) \\ T^*_{2M}(M+k) = -T^*_M\left(\frac{M}{2} - k - 1\right)h_s\left(\left\lceil N + k\frac{N}{M}\right\rceil + d\right) \\ T^*_{2M}\left(\frac{3M}{2} + k\right) = -T^*_M(k)h_s\left(\left\lfloor \frac{3N}{2} - 1 + (k+1)\frac{N}{M}\right\rfloor - d\right) \end{cases} \tag{10}$$

$$k \in [0; N/2-1]$$

Here again, these equations do not result in any additional complexity compared to the conventional unfolding equations. They make it possible to obtain a window decimation on the fly without having any preliminary computations to perform and without having to store additional windows.

In the case where the synthesis window is the temporal reversal of the analysis window ($h_s(k)=h_a(2N-1-k)$), and the ratio N/M is an integer (therefore only a decimation), the equations 10 become:

$$\begin{cases} T^*_{2M}(k) = T^*_M\left(\frac{M}{2} + k\right)h_s\left((2M-k)\frac{N}{M} - 1 - d\right) \\ T^*_{2M}\left(\frac{M}{2} + k\right) = -T^*_M(M-k-1)h_s\left(\left(\frac{3M}{2} - k - 1\right)\frac{N}{M} + d\right) \\ T^*_{2M}(M+k) = -T^*_M\left(\frac{M}{2} - k - 1\right)h_s\left((M-k)\frac{N}{M} - 1 - d\right) \\ T^*_{2M}\left(\frac{3M}{2} + k\right) = -T^*_M(k)h_s\left(\left(\frac{M}{2} - k - 1\right)\frac{N}{M} + d\right) \end{cases} \tag{11}$$

$$k \in [0; N/2-1]$$

This embodiment makes it possible to have in memory only a single window used at a time for the analysis and the synthesis.

It has therefore been shown that the folding/unfolding and decimation steps can be combined in order to perform a transform of size M by using an analysis/synthesis window provided for a size N. By virtue of the invention, a complexity identical to the application of a transform of size M with an analysis/synthesis window provided for a size M is obtained, and without the use of additional memory. Note that this effect is revealed for an effective implementation of the MDCT transform based on a DCT IV (as suggested in H. S. Malvar, Signal Processing with Lapped Transforms, Artech House, 1992), this effect could also be brought to light with other effective implementations, notably the one proposed by Duhamel et al. in "A fast algorithm for the implementation of filter banks based on TDAC" presented at the ICASSP91 conference).

This method is not limiting, it can be applied notably in the case where the analysis window presents 0s and where it is applied to the frame by offset (the most recent sound samples are weighted by the window portion just before the portion presenting 0s) to reduce the coding delay. In this case, the indices assigned to the frames and those assigned to the windows are offset.

In a particular embodiment, there now follows a description of an interpolation method in the case where there is a window h of size 2N and there are frames of size M.

In the case where N is less than M, a similar selection of a set of coefficients observing the perfect reconstruction conditions is also performed. A set of coefficients adjacent to the coefficients of the defined set is also determined. The interpolation then being performed by inserting a coefficient between each of the coefficients of the set of defined coefficients and each of the coefficients of a set of adjacent coefficients to obtain the interpolated window.

Thus, to observe the perfect reconstruction conditions defined by the equation (3), if the aim is to insert a sample between the positions k and k+1, it is proposed to insert points between the positions $h_a(k)$ and $h_a(k+1)$, $h_a(N-k-1)$ and $h_a(N-k-2)$, $h_a(N+k)$ and $h_a(N+k+1)$, $h_a(2N-1-k)$ and $h_a(2N-k-2)$ on the analysis window and points between the positions $h_s(k)$ and $h_s(k+1)$, $h_s(N+k)$ and $h_s(N+k+1)$, $h_s(2N-1-k)$ and $h_s(2N-k-2)$, $h_s(N-1-k)$ and $h_s(N-k-2)$ on the synthesis window. The 8 new points inserted also observe the perfect reconstruction conditions of the equation (3).

In a first embodiment, the interpolation is performed by the repetition of a coefficient of the defined set or of the set of adjacent coefficients.

In a second embodiment, the interpolation is performed by the computation of a coefficient (hcomp) in order to obtain a better frequency response for the window obtained.

For this, a first step of computation of a complementary window $h_{init}$ of size 2N is performed. This window is a version interpolated between the coefficients of h of size 2N, such that:

$$\begin{cases} h_{init}(k) = (h(k-1) + h(k))/2 \text{ for } K \in [1; 2N-1] \\ h_{init}(0) = h(0)/2 \end{cases} \tag{12}$$

In a second step, the window hcomp is computed according to EP 2319039 so that it exhibits perfect reconstruction. For this, the window is computed on the coefficients of the defined set according to the following equations:

$$\begin{cases} hcomp(k) = \dfrac{h_{init}(k)}{\sqrt{h_{init}(N+k)^2 + h_{init}(k)^2}} & \text{for } k \in [1; N-1] \\ hcomp(k+N) = \dfrac{h_{comp}(k+N)}{\sqrt{h_{init}(N+k)^2 + h_{init}(k)^2}} & \text{for } k \in [1; N-1] \end{cases} \tag{13}$$

This window is either computed on initialization, or stored in ROM.

The interpolation and decimation steps can be integrated to exhibit an embodiment in which a transform is effectively applied.

This embodiment is illustrated with reference to FIGS. 4A and 4B.

Figure 4A:
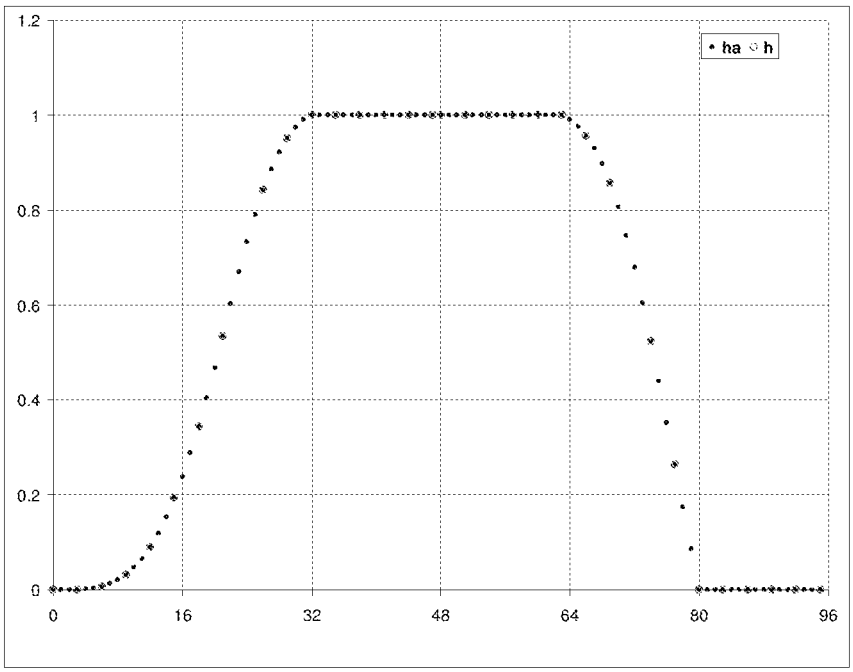
FIG. 4A illustrates a decimation substep of an irregular sampling of an analysis or synthesis window of rational factor (⅔) in one embodiment of the invention.

It is broken down into two steps:

- In a first step illustrated in FIG. 4A, the method starts from a window $h_a$ of size 2N to obtain a second window h of size 2N' (here 2N=96 and 2N'=32, that is to say that a decimation by a factor 3 is performed). This decimation is irregular and conforms to the equation (7).
- In a second step illustrated in FIG. 4B, a set of complementary coefficients hcomp is added to the 2N' coefficients of h to obtain a total of 2M coefficients (here the number of complementary coefficients is 2N', so 2M=4N' are obtained).

Figure 4B:
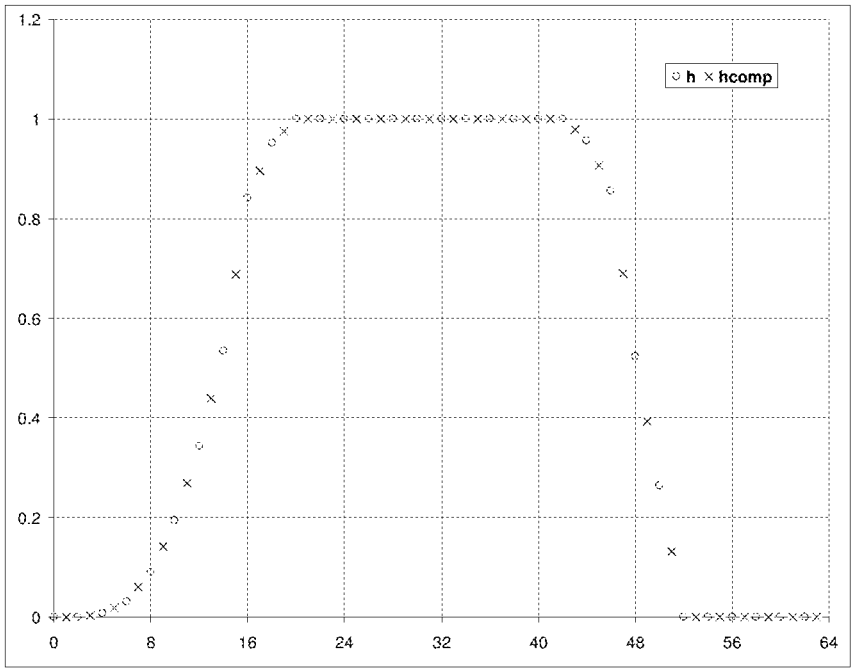
FIG. 4B illustrates an interpolation substep of an irregular sampling of an analysis or synthesis window of rational factor (⅔) in one embodiment of the invention.

In the particular example in FIGS. 4A and 4B there has been a conversion from an initial window of size 2N=96 provided for an MDCT of size N=48 to a window intended to implement an MDCT of size M=32, by constructing a window of size 2M=64.

At the time of the transform, in the block 102, the window h and the window hcomp are applied alternately by observing the following equations:

$$\begin{cases} T_M(k+1) = -T_{2M}\left(\frac{3M}{2} - (k+1) - 1\right)h\left(\frac{3N}{2} - k/2 - 1\right) - \\ T_{2M}\left(\frac{3M}{2} + k + 1\right)h\left(\frac{3N}{2} + k/2\right) \\ T_M(k) = -T_{2M}\left(\frac{3N}{2} - k - 1\right)hcomp\left(\frac{3N}{2} - k/2 - 1\right) - \\ T_{2M}\left(\frac{3N}{2} + k\right)hcomp\left(\frac{3N}{2} + k/2\right) \\ T_M(N/2+k) = T_{2M}(k)h(k/2) - T_{2M}(N-k-1)h(N-k/2-1) \\ T_M(N/2+k+1) = T_{2M}(k+1)hcomp(k/2) - \\ T_{2M}(N-(k+1)-1)hcomp(N-k/2-1) \end{cases} \tag{14}$$

Similarly, at the time of the inverse transform in the block 112, the window h then the window hcomp are applied alternately according to the equations:

$$\begin{cases} T^*_{2M}(k) = T^*_M\left(\frac{N}{2}+k\right)h(2N-k/2-1) \\ T^*_{2M}(k+1) = T^*_M\left(\frac{N}{2}+k+1\right)hcomp(2N-k/2-1) \\ T^*_{2M}\left(\frac{N}{2}+k+1\right) = -T^*_M(N-(k+1)-1)h\left(\frac{3N}{2}-k/2-1\right) \\ T^*_{2M}\left(\frac{N}{2}+k\right) = -T^*_M(N-k-1)hcomp\left(\frac{3N}{2}-k/2-1\right) \\ T^*_{2M}(N+k) = -T^*_M\left(\frac{N}{2}-k-1\right)h(N-k/2-1) \\ T^*_{2M}(N+k+1) = -T^*_M\left(\frac{N}{2}-(k+1)-1\right)hcomp(N-k/2-1) \\ T^*_{2M}\left(\frac{3N}{2}+k+1\right) = -T^*_M(k+1)h\left(\frac{N}{2}-k/2-1\right) \\ T^*_{2M}\left(\frac{3N}{2}+k\right) = -T^*_M(k)hcomp\left(\frac{N}{2}-k/2-1\right) \end{cases} \quad (15)$$

$$k/2 \in [0; N/2-1]$$

Numerous declinations are possible according to the invention. Thus, from a single window stored in memory, it is possible to obtain a window of different size whether by interpolation, by decimation or by interpolation of a decimated window or vice versa.

The flexibility of the coding and of the decoding is therefore great without in any way increasing the memory space or the computations to be performed.

Implementing the decimation or the interpolation at the time of the folding or of the unfolding of the MDCT provides an additional saving in complexity and in flexibility.

Figure 5:
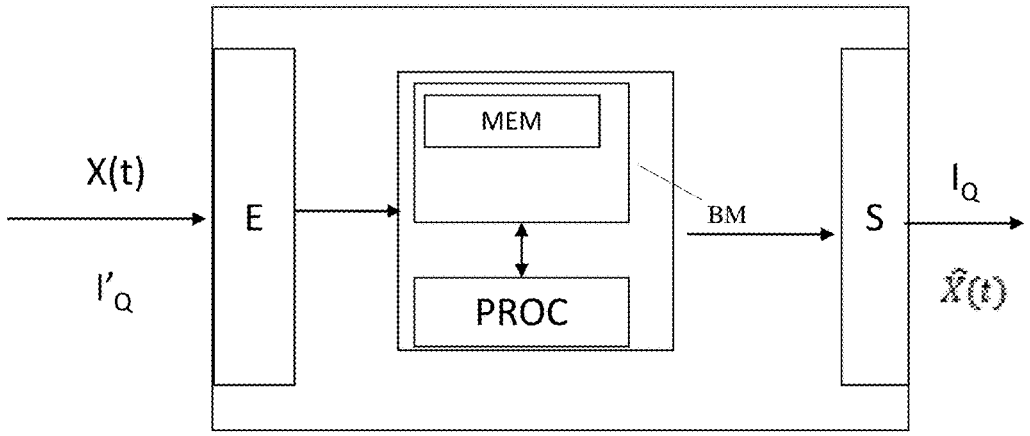
FIG. 5 illustrates an example of a hardware embodiment of a coding or decoding device according to the invention.

FIG. 5 represents a hardware embodiment of a coding or decoding device according to the invention. This device comprises a processor PROC cooperating with a memory block BM comprising a storage and/or working memory MEM.

The memory block can advantageously include a computer program comprising code instructions for the implementation of the steps of the coding or decoding method as per the invention, when these instructions are run by the processor PROC, and notably an irregular sampling of an initial window provided for a transform of given initial size N, in order to apply a secondary transform of size M different from N.

Typically, the description of FIG. 1 reprises the steps of an algorithm of such a computer program. The computer program can also be stored on a memory medium that can be read by a drive of the device or that can be downloaded into the memory space thereof.

Such equipment comprises an input module suitable for receiving an audio stream X(t) in the case of the coder or quantization indices $I_Q$ in the case of a decoder.

The device comprises an output module suitable for transmitting quantization indices $I_Q$ in the case of a coder or the decoded stream $\hat{X}(t)$ in the case of the decoder.

In one possible embodiment, the device thus described can comprise both the coding and decoding functions.

Although the present disclosure has been described with reference to one or more examples, workers skilled in the art will recognize that changes may be made in form and detail without departing from the scope of the disclosure and/or the appended claims.

What is claimed is:

1. A method comprising:

receiving a digital audio signal through an input;

coding the digital audio signal to produce output quantization indices with a processor, the coding comprising a transform coding using analysis weighting windows applied to sample frames and obtained from an irregular sampling of an initial window provided for a transform of given initial size N, to apply a secondary transform of size M different from N, comprising performing the irregular sampling and a decimation or interpolation of the initial window during an act of implementing temporal folding used for computation of the secondary transform, wherein the decimation during the temporal folding is performed according to the following equation:

$$\begin{cases} T_M(k) = -T_{2M}\left(\frac{3M}{2}-k-1\right)h_a\left(\left\lceil\frac{3N}{2}-(k+1)\frac{N}{M}\right\rceil+d\right)- \\ T_{2M}\left(\frac{3M}{2}+k\right)h_a\left(\left\lfloor\frac{3N}{2}-1+(k+1)\frac{N}{M}\right\rfloor-d\right) \\ T_M(M/2+k) = T_{2M}(k)h_a\left(\left\lceil k\frac{N}{M}\right\rceil+d\right)- \\ T_{2M}(M-k-1)h_a\left(\left\lfloor N-1-k\frac{N}{M}\right\rfloor-d\right) \end{cases}$$

$$k \in [0; M/2-1]$$

with $T_M$ being a frame of M samples, $T_{2M}$, a frame of 2M samples; and transmitting through an output the output quantization indices.

2. The method as claimed in claim 1, wherein both a decimation and an interpolation of the initial window are performed during the act of implementing a temporal folding used for computation of the secondary transform.

3. The method as claimed in claim 2, wherein, when the secondary transform is of size M=3/2N, the decimation of the initial window followed by an interpolation is performed during the temporal folding according to the following equations:

$$\begin{cases} T_M(k+1) = -T_{2M}\left(\frac{3M}{2}-(k+1)-1\right)h\left(\frac{3N}{2}-k/2-1\right)- \\ T_{2M}\left(\frac{3M}{2}+k+1\right)h\left(\frac{3N}{2}+k/2\right) \\ T_M(k) = -T_{2M}\left(\frac{3N}{2}-k-1\right)hcomp\left(\frac{3N}{2}-k/2-1\right)- \\ T_{2M}\left(\frac{3N}{2}+k\right)hcomp\left(\frac{3N}{2}+k/2\right) \\ T_M(N/2+k) = T_{2M}(k)h(k/2)-T_{2M}(N-k-1)h(N-k/2-1) \\ T_M(N/2+k+1) = T_{2M}(k+1)hcomp(k/2)- \\ T_{2M}(N-(k+1)-1)hcomp(N-k/2-1) \end{cases}$$

$$k/2 \in [0; N/2-1]$$

with hcomp being a complementary window.

4. A device comprising:

an input configured to receive a digital audio signal;

an output configured to transmit output quantization indices;

a non-transitory computer-readable memory; and a coder configured to code the digital audio signal to produce the output quantization indices, comprising a transform coder module using analysis weighting windows applied to sample frames, the coder comprising:

a sampling module matched for irregularly sampling an initial window provided for a transform of given initial size N, in order to apply a secondary transform of size M different from N, wherein the initial window is stored in the non-transitory computer-readable memory, and wherein the irregular sampling and a decimation or interpolation of the initial window are performed during an act of implementing temporal folding used for computation of the secondary transform, wherein the decimation during the temporal folding is performed according to the following equation:

$$\begin{cases} T_M(k) = -T_{2M}\left(\frac{3M}{2} - k - 1\right)h_o\left(\left\lceil \frac{3N}{2} - (k+1)\frac{N}{M} \right\rceil + d\right) - \\ T_{2M}\left(\frac{3M}{2} + k\right)h_o\left(\left\lfloor \frac{3N}{2} - 1 + (k+1)\frac{N}{M} \right\rfloor - d\right) \\ T_M(M/2 + k) = T_{2M}(k)h_o\left(\left\lceil k\frac{N}{M} \right\rceil + d\right) - T_{2M}(M - k - 1) \\ h_o\left(\left\lfloor N - 1 - k\frac{N}{M} \right\rfloor - d\right) \end{cases}$$

$$k \in [0; M/2 - 1]$$

with $T_M$ being a frame of M samples, $T_{2M}$, a frame of 2M samples.

5. The device of claim 4, wherein the coder for coding comprises:

a memory storing instructions; and a processor, which is configured by the instructions to code the digital audio signal by transform and irregularly sample the initial window provided for the transform of the given initial size N.

6. A non-transitory computer-readable medium comprising a computer program stored thereon and comprising code instructions for implementation of steps of a method of coding, when these instructions are run by a processor, wherein the method comprises:

receiving a digital audio signal through an input;

coding the digital audio signal to produce output quantization indices with the processor, the coding comprising a transform coding using analysis weighting windows applied to sample frames and obtained from an irregular sampling of an initial window provided for a transform of given initial size N, to apply a secondary transform of size M different from N, including storing the initial window in the computer-readable medium, and performing the irregular sampling and a decimation or interpolation of the initial window during an act of implementing temporal folding used for computation of the secondary transform, wherein the decimation during the temporal folding is performed according to the following equation:

$$\begin{cases} T_M(k) = -T_{2M}\left(\frac{3M}{2} - k - 1\right)h_o\left(\left\lceil \frac{3N}{2} - (k+1)\frac{N}{M} \right\rceil + d\right) - \\ T_{2M}\left(\frac{3M}{2} + k\right)h_o\left(\left\lfloor \frac{3N}{2} - 1 + (k+1)\frac{N}{M} \right\rfloor - d\right) \\ T_M(M/2 + k) = T_{2M}(k)h_o\left(\left\lceil k\frac{N}{M} \right\rceil + d\right) - T_{2M}(M - k - 1) \\ h_o\left(\left\lfloor N - 1 - k\frac{N}{M} \right\rfloor - d\right) \end{cases}$$

$$k \in [0; M/2 - 1]$$

with $T_M$ being a frame of M samples, $T_{2M}$, a frame of 2M samples; and transmitting through an output the output quantization indices.

7. A method comprising:

receiving input quantization indices through an input;

decoding the input quantization indices to produce a decoded digital audio signal with a processor, the decoding comprising a transform decoding using synthesis weighting windows applied to sample frames and obtained from an irregular sampling of an initial window provided for a transform of given initial size N, to apply a secondary transform of size M different from N, comprising performing the irregular sampling and a decimation or interpolation of the initial window during an act of implementing temporal unfolding used for computation of the secondary transform wherein the decimation during the temporal unfolding is performed according to the following equation:

$$\begin{cases} T^*_{2M}(k) = T^*_M\left(\frac{M}{2} + k\right)h_s\left(\left\lceil k\frac{N}{M} \right\rceil + d\right) \\ T^*_{2M}\left(\frac{M}{2} + k\right) = -T^*_M(M - k - 1)h_s\left(\left\lfloor \frac{N}{2} - 1 + (k+1)\frac{N}{M} \right\rfloor - d\right) \\ T^*_{2M}(M + k) = -T^*_M\left(\frac{M}{2} - k - 1\right)h_s\left(\left\lceil N + k\frac{N}{M} \right\rceil + d\right) \\ T^*_{2M}\left(\frac{3M}{2} + k\right) = -T^*_M(k)h_s\left(\left\lfloor \frac{3N}{2} - 1 + (k+1)\frac{N}{M} \right\rfloor - d\right) \end{cases}$$

$$k \in [0; N/2 - 1]$$

with $T^*_M$ being a frame of M samples, $T^*_{2M}$, a frame of 2M samples; and providing through an output the decoded digital audio signal.

8. The method as claimed in claim 7, wherein both a decimation and an interpolation of the initial window are performed during the act of implementing a temporal unfolding used for computation of the secondary transform.

9. The method as claimed in claim 8, wherein, when the secondary transform is of size M=3/2N, the decimation of the initial window followed by an interpolation is performed during the temporal unfolding according to the following equations:

$$\begin{cases} T^*_{2M}(k) = T^*_M\left(\frac{N}{2}+k\right)h(2N-k/2-1) \\ T^*_{2M}(k+1) = T^*_M\left(\frac{N}{2}+k+1\right)hcomp(2N-k/2-1) \\ T^*_{2M}\left(\frac{N}{2}+k+1\right) = -T^*_M(N-(k+1)-1)h\left(\frac{3N}{2}-k/2-1\right) \\ T^*_{2M}\left(\frac{N}{2}+k\right) = -T^*_M(N-k-1)hcomp\left(\frac{3N}{2}-k/2-1\right) \\ T^*_{2M}(N+k) = -T^*_M\left(\frac{N}{2}-k-1\right)h(N-k/2-1) \\ T^*_{2M}(N+k+1) = -T^*_M\left(\frac{N}{2}-(k+1)-1\right)hcomp(N-k/2-1) \\ T^*_{2M}\left(\frac{3N}{2}+k+1\right) = -T^*_M(k+1)h\left(\frac{N}{2}-k/2-1\right) \\ T^*_{2M}\left(\frac{3N}{2}+k\right) = -T^*_M(k)hcomp\left(\frac{N}{2}-k/2-1\right) \end{cases}$$

$$k/2 \in [0; N/2-1]$$

with $T_M$ being a frame of M samples, $T_{2M}$, a frame of 2M samples, hcomp a complementary window.

10. A device comprising:

an input configured to receive input quantization indices;

an output configured to provide a decoded digital audio signal;

a non-transitory computer-readable memory; and a decoder configured to decode the input quantization indices to produce the decoded digital audio signal, comprising a transform decoder module using synthesis weighting windows applied to sample frames, the decoder comprising:

a sampling module matched for irregularly sampling an initial window provided for a transform of given initial size N, in order to apply a secondary transform of size M different from N, wherein the initial window is stored in the non-transitory computer-readable memory, and wherein the irregular sampling and a decimation or interpolation of the initial window are performed during an act of implementing temporal unfolding used for computation of the secondary transform, wherein the decimation during the temporal unfolding is performed according to the following equation:

$$\begin{cases} T^*_{2M}(k) = T^*_M\left(\frac{M}{2}+k\right)h_s\left(\left\lceil k\frac{N}{M}\right\rceil+d\right) \\ T^*_{2M}\left(\frac{M}{2}+k\right) = -T^*_M(M-k-1)h_s\left(\left\lfloor \frac{N}{2}-1+(k+1)\frac{N}{M}\right\rfloor-d\right) \\ T^*_{2M}(M+k) = -T^*_M\left(\frac{M}{2}-k-1\right)h_s\left(\left\lceil N+k\frac{N}{M}\right\rceil+d\right) \\ T^*_{2M}\left(\frac{3M}{2}+k\right) = -T^*_M(k)h_s\left(\left\lfloor \frac{3N}{2}-1+(k+1)\frac{N}{M}\right\rfloor-d\right) \end{cases}$$

$$k \in [0; N/2-1]$$

with $T^*_M$ being a frame of M samples, $T^*_{2M}$, a frame of 2M samples.

11. The device of claim 10, wherein the decoder for decoding comprises:

a memory storing instructions; and a processor, which is configured by the instructions to decode the digital audio signal by transform and irregularly sample the initial window provided for the transform of the given initial size N.

12. A non-transitory computer-readable medium comprising a computer program stored thereon and comprising code instructions for implementation of steps of a method of decoding, when these instructions are run by a processor, wherein the method comprises:

receiving input quantization indices through an input;

decoding the input quantization indices to produce a decoded digital audio signal with the processor, the decoding comprising a transform decoding using synthesis weighting windows applied to sample frames and obtained from an irregular sampling of an initial window provided for a transform of given initial size N, to apply a secondary transform of size M different from N, including storing the initial window in the computer-readable medium, and performing the irregular sampling and a decimation or interpolation of the initial window during an act of implementing temporal unfolding used for computation of the secondary transform, wherein the decimation during the temporal unfolding is performed according to the following equation:

$$\begin{cases} T^*_{2M}(k) = T^*_M\left(\frac{M}{2}+k\right)h_s\left(\left\lceil k\frac{N}{M}\right\rceil+d\right) \\ T^*_{2M}\left(\frac{M}{2}+k\right) = -T^*_M(M-k-1)h_s\left(\left\lfloor \frac{N}{2}-1+(k+1)\frac{N}{M}\right\rfloor-d\right) \\ T^*_{2M}(M+k) = -T^*_M\left(\frac{M}{2}-k-1\right)h_s\left(\left\lceil N+k\frac{N}{M}\right\rceil+d\right) \\ T^*_{2M}\left(\frac{3M}{2}+k\right) = -T^*_M(k)h_s\left(\left\lfloor \frac{3N}{2}-1+(k+1)\frac{N}{M}\right\rfloor-d\right) \end{cases}$$

$$k \in [0; N/2-1]$$

with $T^*_M$ being a frame of M samples, $T^*_{2M}$, a frame of 2M samples; and providing through an output the decoded digital audio signal.

* * * * *